US007622433B2

(12) United States Patent
Kaneshige et al.

(10) Patent No.: US 7,622,433 B2
(45) Date of Patent: Nov. 24, 2009

(54) LUBRICATING OIL COMPOSITION AND INTERNAL COMBUSTION ENGINE OIL

(75) Inventors: Ryousuke Kaneshige, Ichihara (JP); Keiji Okada, Sodegaura (JP); Masaaki Kawasaki, Ichihara (JP); Satoshi Ikeda, Ichihara (JP)

(73) Assignees: Mitsui Chemicals, Inc., Tokyo (JP); The Lubrizol Corporation, Wickliffe, OH (US)

( * ) Notice: Subject to any disclaimer, the term of this patent is extended or adjusted under 35 U.S.C. 154(b) by 463 days.

(21) Appl. No.: 10/534,580

(22) PCT Filed: Nov. 11, 2003

(86) PCT No.: PCT/JP03/14311

§ 371 (c)(1),
(2), (4) Date: May 11, 2005

(87) PCT Pub. No.: WO2004/044108

PCT Pub. Date: May 27, 2004

(65) Prior Publication Data

US 2006/0122079 A1 Jun. 8, 2006

(30) Foreign Application Priority Data

Nov. 12, 2002 (JP) ..... 2002-327750
Dec. 4, 2002 (JP) ..... 2002-352240
Dec. 4, 2002 (JP) ..... 2002-353129

(51) Int. Cl.
*C10L 1/16* (2006.01)

(52) U.S. Cl. ..... 508/591

(58) Field of Classification Search ..... 508/591
See application file for complete search history.

(56) References Cited

U.S. PATENT DOCUMENTS 4,666,619 A 5/1987 Kresge et al.
6,322,692 B1 * 11/2001 Cody et al. ..... 208/18
6,459,005 B1 10/2002 Hirano et al.
2002/0035044 A1 * 3/2002 Okada et al. ..... 508/591
2002/0055445 A1 5/2002 Okada et al.

FOREIGN PATENT DOCUMENTS

| | | | |
|---|---|---|---|
| CN | 1329656 | A | 1/2002 |
| CN | 1346398 | A | 4/2002 |
| CN | 1396304 | A | 2/2003 |
| EP | 188103 | A2 | 7/1986 |
| EP | 632066 | A1 | 1/1995 |
| GB | 2047266 | A | 11/1980 |
| JP | 7-150181 | A | 6/1995 |
| WO | WO-00/34420 | A1 | 6/2000 |
| WO | WO-00/60032 | A1 | 10/2000 |

* cited by examiner

*Primary Examiner*—Glenn A Caldarola
*Assistant Examiner*—Taiwo Oladapo
(74) *Attorney, Agent, or Firm*—Birch, Stewart, Kolasch & Birch, LLP

(57) ABSTRACT

The present invention provides a lubricating oil composition having excellent low temperature viscosity properties suitable for engine oils for automobiles and industries, gear oils, shock absorber oils, hydraulic fluids and it also provides a lubricating oil for internal-combustion engines formed from the composition.

The lubricating oil composition comprises;

a lubricating oil base (A) having a kinematic viscosity at 100° C. of 1 to 50 $mm^2/s$ and a viscosity index of not less than 80, an ethylene•propylene copolymer (B) having the following properties (B1) to (B4) such that (B1) the ethylene content is from 30 to 75% by weight, (B2) the intrinsic viscosity [η] is from 1.3 to 2.0 dl/g, (B3) the Mw/Mn is not more than 2.4 and (B4) the melting point as measured with DSC is not higher than 30° C., and optionally a pour point depressant (C).

3 Claims, No Drawings

LUBRICATING OIL COMPOSITION AND INTERNAL COMBUSTION ENGINE OIL

TECHNICAL FIELD

The present invention relates to a lubricating oil composition containing a specific ethylene•propylene copolymer as a lubricating oil viscosity improver and to a lubricating oil for internal-combustion engines which oil contains the composition.

TECHNICAL BACKGROUND

Petroleum products generally have a viscosity which exhibits large variation with change in temperature, namely have temperature dependence of viscosity. For example, lubricating oils used for automobiles or the like preferably have low temperature dependence of viscosity. In order to decrease the temperature dependence of viscosity, a certain kind of polymers soluble in lubricating oil bases is used in the lubricating oils as a viscosity index improver. In recent years, ethylene•α-olefin copolymers have been widely used as viscosity index improvers and, further, the ethylene•α-olefin copolymers have been variously improved in order to further improve the properties of the lubricating oils (refer to Publication of WO00/34420).

The viscosity index improver is generally used so that the lubricating oil retains a proper viscosity at high temperatures. Recently, the quality standard of lubricating oils typified by engine oils has been advanced, and therefore, a polymer for viscosity index improvers capable of reducing the viscosity elevation at low temperatures (having excellent low-temperature properties) has been particularly desired. In the lubricating oil application, it is desirable to reduce the polymer concentration as low as possible in order that the lubricating oils have more excellent low-temperature properties. Use of a polymer having a higher molecular weight is known for the above reason and also for economical advantage. However, if the molecular weight is increased and the addition amount of the polymer is decreased, a problem appears in that the shear stability is decreased.

Furthermore, common lubricating oils contain a paraffin type mineral oil, and the paraffin type mineral oil contains a paraffin wax component in an amount of 1 to 5%. The paraffin wax forms a plate-like crystal at low temperatures and further absorbs oil components to impart a three-dimensional network structure so that the fluidity of the whole lubricating oil is greatly lowered. A pour-point depressant is simultaneously used in order to improve the fluidity by making this plate-like crystal into an amorphous state. However, the effects of the pour point depressant vary largely depending on the kind of lubricating oil base and therefore it is required to select a pour point depressant suitable for each lubricating oil base.

In application in engine oils for automobiles and industries, gear oils (including ATF), hydraulic fluids and the like, the utilization of highly purified lubricating oil bases, such as oils classified in groups (II) and (III) has increased in place of oils classified in the group (I) which have been conventionally widely used as a lubricating oil base, in order to cope with the sophistication of required properties associated with setting new standards and the enforcement of environmental regulations.

The engine oil application has a large problem in that low-temperature viscosity as measured by Mini-Rotary Viscometer (parameters of oil pumping properties), which is a major standard, is increased.

The present inventors found that high molecular weight ethylene•α-olefin copolymers are suitable as viscosity index improvers for lubricating oils having excellent low temperature properties and economical properties, but if the molecular weight thereof is too high, the solubility in the lubricating oil base is lowered and the low temperature properties become worse. They also found that the use of highly purified lubricating base oil produces a tendency that the solubility of the high molecular weight ethylene•α-olefin copolymers is further lowered.

Under the circumstances, the present inventors have been diligently studied the above problems and found that they are solved by using a viscosity index improver which is an ethylene•propylene copolymer, having an ethylene content, molecular weight, molecular weight distribution and melting point in specific ranges, and optionally using a pour point depressant as needed. Thus, the present invention has been accomplished.

It is an object of the present invention to provide a lubricating oil composition having excellent viscosity properties at low temperature and thickening power suitable for engine oils for automobiles and industrial applications, gear oils, shock absorber oils, hydraulic fluids. The invention further provides a lubricating oil for internal-combustion engines formed from the composition.

DISCLOSURE OF THE INVENTION

The lubricating oil composition (AA) of the present invention comprises:

80 to 99% by weight of a lubricating oil base (A) having a kinematic viscosity at 100° C. of 1 to 50 $mm^2/s$ and a viscosity index of not less than 80, and 1 to 20% by weight of an ethylene•propylene copolymer (B) having the following properties (B1) to (B4):

(B1) the ethylene content is from 30 to 75% by weight, (B2) the intrinsic viscosity [η] is from 1.3 to 2.0 dl/g, (B3) Mw/Mn is not more than 2.4 and (B4) the melting point as measured with DSC is not higher than 30° C.

In the lubricating oil composition (AA) of the present invention, the lubricating oil base (A) is preferably a mineral oil or poly-α-olefin having the following properties (A1) to (A3):

(A1) the viscosity index is not less than 80, (A2) the saturated hydrocarbon content is not less than 90% by volume, and (A3) the sulfur content is not more than 0.03% by weight.

The lubricating oil composition (BB) of the present invention comprises:

92 to 99.85% by weight of a lubricating oil base (A) having a kinematic viscosity at 100° C. of 1 to 50 $mm^2/s$ and a viscosity index of not less than 80;

0.1 to 5% by weight of an ethylene•propylene copolymer (B) having the following properties (B1) to (B4):

(B1) the ethylene content is from 30 to 75% by weight, (B2) the intrinsic viscosity [η] is from 1.3 to 2.0 dl/g, (B3) Mw/Mn is not more than 2.4 and (B4) the melting point as measured with DSC is not higher than 30° C.; and 0.05 to 3% by weight of a pour-point depressant (C).

In the present invention, the pour-point depressant (C) preferably has a melting point as measured with DSC of not higher than −13° C.

The lubricating oil for internal-combustion engines of the present invention comprises the lubricating oil composition (BB).

BEST EMBODIMENT FOR CARRYING OUT THE INVENTION

The lubricating oil composition and the lubricating oil for internal-combustion engines of the present invention are described below.

The lubricating oil composition (AA) of the present invention comprises a lubricating oil base (A) and an ethylene•propylene copolymer (B), and the lubricating oil composition (BB) comprises the lubricating oil base (A) and the ethylene•propylene copolymer (B) and a pour point depressant (C).

First, each of the components contained in the lubricating oil compositions of the present invention is described.

Lubricating Oil Base (A)

The lubricating oil base (A) used in the present invention may include mineral oils and synthetic oils such as poly-α-olefins, polyol esters and diesters.

Mineral oils subjected to a purification step such as dewaxing or the like are generally used and have grades designated in accordance with purification procedures. The grades are defined by the API (American Petroleum Institute) classification. In Table 1, the properties of the lubricating oil bases classified into each of the groups are shown.

TABLE 1

| Group | Kind | Viscosity index*1 | Saturated hydrocarbon component (volume %)*2 | Sulfur component*3 (% by weight) |
|---|---|---|---|---|
| (I)*4 | Mineral oil | 80 to 120 | <90 | >0.03 |
| (II) | Mineral oil | 80 to 120 | ≧90 | ≦0.03 |
| (III) | Mineral oil | ≧120 | ≧90 | ≦0.03 |
| (IV) | Poly-α-olefin | | | |
| (V) | Lubricating oil bases other than the above | | | |

*1Measured in accordance with ASTM D445 (JIS K2283)
*2Measured in accordance with ASTM D3238
*3Measured in accordance with ASTM D4294 (JIS K2541)
*4Mineral oil having a saturated hydrocarbon component of less than 90% by volume, and a sulfur component of less than 0.03% by weight, and mineral oil having a saturated hydrocarbon component of not less than 90% by volume, and a sulfur component of more than 0.03% by weight, are also classified in the group (I).

The poly-α-olefin in Table 1 is a hydrocarbon polymer obtainable by polymerization using an α-olefin having at least 10 carbon atoms as at least one raw material monomer, for example a polydecene obtainable by polymerizing decene-1.

The mineral oils used as the lubricating oil base (A) in the present invention are preferably those belonging to the groups (I) to (IV) having a high degree of purification, preferably a mineral oil or poly-α-olefin having a kinematic viscosity at 100° C. of from 1 to 50 $mm^2/s$ and a viscosity index of not less than 80, more preferably mineral oils belonging to the group (II) or (III) having a high degree of purification or poly-α-olefins belonging to the group (IV) having a high degree of purification.

The mineral oils may contain other mineral oils and synthetic oils such as poly-α-olefins, polyol esters and diesters in amounts of not more than 20% by weight.

In the present invention, the mineral oils or poly-α-olefins having the following properties (A1) to (A3) are preferred as the lubricating oil base (A). Of these lubricating oil bases, mineral oils having the properties (A1) to (A3) are particularly preferred.

(A1) The viscosity index is not less than 80.

(A2) The saturated hydrocarbon content is not less than 90% by volume.

(A3) The sulfur content is not more than 0.03% by weight.

The viscosity index, saturated hydrocarbon component and sulfur component are measured by the following methods.

Viscosity Index:

The viscosity index is measured in accordance with ASTM D445 (JIS K2283)

Saturated Hydrocarbon Component:

The saturated hydrocarbon content is measured in accordance with ASTM D3238

Sulfur Component:

The sulfur content is measured in accordance with ASTM D4294 (JIS K2541)

Ethylene•Propylene Copolymer (B)

The ethylene•propylene copolymer (B) used in the present invention is a polymer for improving a viscosity index.

The ethylene•propylene copolymer (B) may contain a repeating unit derived from at least one monomer selected from cycloolefins and polyenes (hereinafter referred to as "another monomer") in an amount of not more than 5% by weight, preferably not more than 1% by weight, while still satisfying the object of the present invention.

In one preferred embodiment of the present invention, the composition contains no polyene. The composition free from polyene in particular has excellent heat resistance. The ethylene•propylene copolymer (B) consisting essentially of ethylene and propylene is also preferable.

The ethylene•propylene copolymer (B) has the following properties (B1), (B2), (B3) and (B4).

(B1) Ethylene Content

The ethylene•propylene copolymer (B) usually has an ethylene content of from 30 to 75% by weight, preferably 40 to 60% by weight, particularly preferably 42 to 52% by weight. The ethylene content of the ethylene•propylene copolymer (B) is measured by $^{13}C$-NMR in accordance with the method described in "Polymer Analysis Handbook" (edited by the Japan Society for Analytical Chemistry, Polymer analysis study group published by Kinokuniya Co., Ltd.).

When the ethylene content of the ethylene•propylene copolymer (B) is in the above range, the resulting lubricating oil composition has well-balanced properties between low temperature properties and shear stability.

(B2) Intrinsic Viscosity [η] (dl/g)

The ethylene•propylene copolymer (B) has an intrinsic viscosity [η] of from 1.3 to 2.0 dl/g, preferably 1.4 to 1.9 dl/g, especially 1.5 to 1.8 dl/g.

The intrinsic viscosity [η] of the ethylene•propylene copolymer (B) is measured in decalin at 135° C.

The resulting lubricating oil composition containing the ethylene•propylene copolymer (B) having an intrinsic viscosity [η] in the above range, in particular, has excellent balance between low temperature properties and thickening properties. Further, if the intrinsic viscosity [η] of the lubricating oil composition is in the above range, it has very low viscosity under low temperature-low shear rate conditions, and also has advantageous pumping properties for lubricating oil pumps and thereby contributes to saving fuel consumption.

(B3) Molecular Weight Distribution

The ethylene•propylene copolymer (B) has a Mw/Mn (Mw: weight average molecular weight and Mn: number average molecular weight), which is an index showing a molecular weight distribution, of not more than 2.4, preferably from 1 to 2.2.

The Mw/Mn of the ethylene•propylene copolymer (B) is measured in an ortho-dichlorobenzene at 140° C. using GPC (gel permeation chromatography).

If the molecular weight distribution is over 2.4, the shear stability of the lubricating oil become worse.

(B4) Melting Point (Tm)

The ethylene•propylene copolymer (B) has a melting point of not higher than 30° C., preferably not higher than 0° C., more preferably not higher than −30° C.

The melting point of the ethylene propylene copolymer (B) is measured with a differential scanning calorimeter (DSC). Specifically, about 5 mg of a specimen is packed in an aluminum pan, heated to 200° C. and kept at 200° C. for 5 min. Thereafter, the specimen is cooled to −40° C. at a rate of 10° C./min and kept at −40° C. for 5 min, and then, by elevating the temperature at a rate of 10° C./min, the melting point is determined from an endothermic curve.

The melting point is an indication of the interaction of the ethylene•propylene copolymer (B) and the pour point depressant (C). It is important that the ethylene•propylene copolymer (B) does not contain ethylene sequences which exhibit a melting point close to that of the pour point depressant (C) (e.g., within the range of −5 to +10° C. of that of the pour point depressant) in order to avoid interaction between the copolymer (B) and the pour point depressant (C).

The ethylene•propylene copolymer (B) used in the present invention can be prepared by copolymerizing ethylene and propylene using a catalyst comprising a transition metal compound such as vanadium, zirconium or titanium, an organoaluminum compound (organoaluminum oxy compound) and/or an ionized ionic compound. The catalyst for olefin polymerization is disclosed in, for example, the Publication of WO00/34420.

Pour Point Depressant (C)

As the pour point depressant in the present invention, a polymer compound having an organic acid ester group is used and, particularly, a vinyl polymer having an organic acid ester group is preferably used. Examples of vinyl polymers having an organic acid ester group may include alkyl methacrylate (co)polymers, alkyl acrylate (co)polymers, alkyl fumarate (co)polymers, alkyl maleate (co)polymers and alkylated naphthalene.

The pour point depressant (C) preferably has the following properties (C1):

(C1) Melting Point of the Pour Point Depressant (C):

The melting point of the pour point depressant (C) is not higher than −13° C., preferably not higher than −15° C., more preferably not higher than −17° C.

The melting point of the pour point depressant (C) is determined by the same method as the method of measuring the melting point of the ethylene•propylene copolymer (B).

The pour point depressant (C) further has the following properties (C2):

(C2) Molecular Weight (Weight Average Molecular Weight in Terms of Polystyrene: Mw) of the Pour Point Depressant (C):

The pour point depressant (C) has a weight average molecular weight of from 20,000 to 400,000, preferably 30,000 to 300,000, more preferably 40,000 to 200,000.

The weight average molecular weight of the pour point depressant (C) is measured in a tetrahydrofuran solvent at 40° C. using GPC (gel permeation chromatography).

Lubricating Oil Composition (AA)

The lubricating oil composition (AA) of the present invention comprises the lubricating oil base (A) and the ethylene•propylene copolymer (B). The lubricating oil composition contains the lubricating oil base (A) in an amount of from 80 to 99% by weight, preferably 85 to 95% by weight and the ethylene•propylene copolymer (B) in an amount of from 1 to 20% by weight, preferably 5 to 15% by weight. In the composition (AA), the total amount of the lubricating oil base (A) and the ethylene•propylene copolymer (B) is 100% by weight of the composition.

The lubricating oil composition has low temperature dependency and excellent low temperature properties. The lubricating oil composition can be used as is, or the lubricating oil composition can be mixed with a lubricating oil base, the pour point depressant or the like to prepare the lubricating oil composition (BB) as described later, and then the resulting lubricating oil composition can be used for various kinds of lubricating oil uses. Lubricating oil bases other than the lubricating oil base (A) may be mixed. To the lubricating oil composition (AA), additives such as pour point depressants, antioxidants, detergent-dispersants, extreme-pressure agents, anti foaming agents, rust preventives, corrosion inhibitors and the like, as described later, may be appropriately added as required.

Lubricating Oil Composition (BB)

The lubricating oil composition (BB) of the present invention comprises the lubricating oil base (A), the ethylene•propylene copolymer (B) and the pour point depressant (C). The lubricating oil composition contains the lubricating oil base (A) in an amount of from 92 to 99.85% by weight, preferably 95 to 99.7% by weight, more preferably 97 to 99.5% by weight, and the ethylene•propylene copolymer (B) in an amount of from 0.1 to 5% by weight, preferably 0.2 to 3% by weight, more preferably 0.4 to 2% by weight, and the pour point depressant (C) in an amount of from 0.05 to 3% by weight, preferably 0.1 to 2% by weight, more preferably 0.1 to 1% by weight. The total amount of the lubricating oil base (A) and the ethylene•propylene copolymer (B) and the pour point depressant (C) is 100% by weight.

The lubricating oil bases, which are added to the lubricating oil composition (AA), may be the same as the lubricating oil base contained in the lubricating oil composition (AA), and further are preferably lubricating oil bases having the above properties (A1) to (A3).

The lubricating oil composition (BB) comprising the lubricating oil base (A), the ethylene•propylene copolymer (B) and the pour point depressant (C) has low temperature dependency and excellent low temperature properties, and particularly has low viscosity under low temperature-low shear rate conditions.

Additives

The lubricating oil composition of the present invention comprises the lubricating oil base (A) and the ethylene propylene copolymer (B) and optionally the pour point depressant (C) and further, additives such as antioxidants, detergent-dispersants, extreme-pressure agents, anti foaming agents, rust preventives, corrosion inhibitors and the like which can be added to the composition as needed.

Examples of the antioxidants may include phenol type antioxidants such as 2,6-di-t-butyl-4-methyl phenol and the like; and amine type antioxidants such as dioctyl diphenylamine and the like.

Examples of the detergent-dispersants may include sulfonate type detergent-dispersants such as calcium sulfonate and magnesium sulfonate; phenates; salicylate; succinimide; and benzylamine.

Examples of the extreme-pressure agents may include sulfurized oils and fats, sulfurized olefins, sulfides, phosphates, phosphites, phosphate amine salts and phosphite amine salts.

Examples of the anti-foaming agents may include silicon type anti-foaming agents such as dimethyl siloxane and silica gel dispersant; and alcohol or ester type anti-foaming agents.

Examples of the rust preventives may include carboxylic acids, carboxylic acid salts, esters and phosphoric acid.

Examples of the corrosion inhibitors may include benzotriazole, its derivative and thiazole type compounds.

Preparation Process

The lubricating oil compositions (AA) and (BB) of the present invention can be prepared by mixing or dissolving the ethylene•propylene copolymer (B) and optionally the pour point depressant (C) and further optionally the additives with or in the lubricating oil base (A) using conventionally known methods.

The lubricating oil composition (BB) is also prepared by adding the pour point depressant (C) and optionally the lubricating oil bases to the lubricating oil composition (AA) In this process, the lubricating oil bases added to the lubricating oil composition (AA) may be same as the lubricating oil base (A) contained in the lubricating oil composition (AA), and preferably are those having the properties (A1) to (A3).

Effect

The lubricating oil compositions of the present invention have low viscosity under low temperature and low shear rate conditions defined in the SAE viscosity standard and also have excellent pumping properties, and therefore, they are useful for lubricating oils used in internal-combustion engines such as engine oils and the like.

EXAMPLE

Hereinafter, the present invention is described in more detail with reference to the following examples. The various physical properties in the examples were measured in the following manner.

Ethylene Content:

The ethylene content was measured in a mixed solvent of ortho-dichlorobenzene and benzene-d6 (ortho-dichlorobenzene/benzene-d6=3/1 to 4/1 (volume ratio)) at 120° C. in a pulse width of 45° for a pulse repeating time of 5.5 sec using a LA500 neclear magnetic resonance apparatus (manufactured by JEOL).

Intrinsic Viscosity [η]:

The intrinsic viscosity [η] was measured in decalin at 135° C.

Mw/Mn:

The Mw/Mn was measured in an ortho-dichlorobenzene solvent at 140° C. using GPC (gel permeation chromatography).

Kinematic Viscosity at 100° C. (K.V.):

The kinematic viscosity was measured based on ASTM D 445. In the present examples, the K.V. of a specimen oil was regulated to be 11 $mm^2/s$.

Mini-Rotary Viscometer (MRV) Viscosity:

The viscosity was measured at −35° C. based on ASTM D 3829 and D4684. The MRV viscosity was used for evaluation of pumping by an oil pump at low temperatures. When the value of the MRV viscosity is smaller, the low temperature properties are better.

Cold Cranking Simulator (CCS) Viscosity:

The CCS viscosity was measured at −250 and −30° C. based on ASTM D2602. The CCS viscosity was used for evaluation of sliding properties (starting properties) at low temperatures in a crank shaft. When the value of the CCS viscosity is smaller, the low temperature properties are better.

Shear Stability Index (SSI):

The SSI was measured based on ASTM D 3945. The SSI is an index of a kinematic viscosity loss induced by molecular chain scission caused after the copolymer components in the lubricating oil are subjected to shear in a metal sliding part. When the SSI value is larger, the loss is larger.

Polymerization Examples 1 to 4

In each example, to a 2 L volume continuous polymerizer equipped with a stirring blade thoroughly purged with nitrogen, 1 L of hexane purified with dehydration was introduced and a 8.0 mmol/L hexane solution of ethyl aluminum sesquichloride ($Al(C_2H_5)_{1.5}.Cl_{1.5}$) was continuously fed for 1 hr at a rate of 500 mL/h and thereafter as a catalyst, a 0.8 mmol/L hexane solution of $VO(OC_2H_5)Cl_2$ at a rate of 500 mL/h and hexane at a rate of 500 mL/h were continuously fed. Meanwhile, from the top part of the polymerizer, a polymerization solution was continuously drawn out so that the amount of the polymerization solution in the polymerizer was constantly 1 L.

Next, using a bubbling tube, ethylene at a rate of 180 L/h, propylene at a rate of 120 L/h and hydrogen at a rate of from 1.5 to 5.5 L/h were fed. The copolymerization reaction was carried out at 15° C. by circulating a refrigerant carrier into a jacket equipped outside the polymerizer.

The reaction was carried out under the above conditions and thereby a polymerization solution containing an ethylene•propylene copolymer was prepared. The resulting polymerization solution was deashed with hydrochloric acid and then introduced into a large amount of methanol to precipitate the ethylene•propylene copolymer. Thereafter, the ethylene•propylene copolymer was dried under reduced pressure at 130° C. for 24 hr. The resulting polymer had the properties as shown in Table 2.

TABLE 2

| | Polymerization Example | | | |
|---|---|---|---|---|
| | 1 | 2 | 3 | 4 |
| Polymerization conditions | | | | |
| Ethylene (l/h) | 180 | 180 | 180 | 180 |
| Propylene(l/h) | 120 | 120 | 120 | 120 |
| Hydrogen(l/h) | 5.5 | 3.5 | 2.0 | 1.5 |
| Polymer properties | | | | |
| Ethylene content (wt %) | 49 | 49 | 50 | 51 |
| [η] (dl/g) | 1.20 | 1.45 | 1.84 | 2.18 |
| Mw/Mn | 2.0 | 1.9 | 2.0 | 2.1 |
| Melting point (° C.) | <−40* | <−40 | <−40 | <−40 |

*The melting point was not observed at −40° C. or higher.

Polymerization Example 5

To a 2 L volume stainless steel autoclave equipped with a stirring blade thoroughly purged with nitrogen, 900 mL of heptane was introduced at 23° C. To this autoclave, 13 NL of propylene and 100 mL of hydrogen were introduced with rotating the stirring blade and ice cooling. Next, the autoclave was heated to 70° C. and pressurized with ethylene so that the total pressure was 6 KG. When the inner pressure of the autoclave reached 6 KG, 1.0 mL of a 1.0 mmol/mL hexane-solution of tributyl aluminum was fed by nitrogen with pressure. Successively, 3 ml of a toluene solution containing 0.02 mM in terms of B of triphenyl carbenium(tetrakis pentafluorophenyl)borate and 0.0005 mmol of [dimethyl(t-butylamide) (tetramethyl-$\eta^5$-cyclopentadienyl) silane]titanium dichloride was fed with pressure into the autoclave and the polymerization was started. Thereafter, for the period of 5 minutes, temperature of the autoclave was controlled so that the inner temperature would become 70° C., and ethylene was directly fed so that the pressure would become 6 kg. After 5 min from the start of polymerization, 5 mL of methanol was fed into the autoclave with a pump to stop the polymerization. Then, the autoclave was vented to atmospheric pressure. Into the reaction solution, 3 L of methanol was poured with stirring. The resulting solvent containing polymer was dried at 130° C. for 13 hr at 600 torr to prepare 31 g of an ethylene•propylene copolymer. The resulting polymer has an ethylene content of 47% by weight, [η] of 1.60 dl/g, Mw/Mn of 2.1 and a melting point of lower than −40° C. (the melting point was not observed at −40° C. or higher).

Example 1

Using 87.85% by weight of a mineral oil 120 neutral (™, manufactured by ESSO Co., Ltd.), which is classified in the group (II), having a kinematic viscosity at 100° C. of 4.60 $mm^2/s$, a viscosity index of 114, a saturated hydrocarbon component of 99% by volume and a sulfur component of not more than 0.001% by weight as a lubricating oil base (A) (base oil), 0.85% by weight of an ethylene•propylene copolymer (B) prepared in Polymerization Example 2 as a viscosity index improver, 0.3% by weight of ACLUBE 146™ (manufactured by Sanyo Chemical Industries, Ltd.) as a pour point depressant (C) and 11.0% by weight of a detergent-dispersant LZ 20003C™ (manufactured by The Lubrizol Corporation), a lubricating oil composition was prepared and the lubricating oil properties thereof were evaluated.

The results are shown in Table 3.

Example 2

The procedure of Example 1 was repeated except for using 0.76% by weight of an ethylene•propylene copolymer prepared in Polymerization Example 5 as a viscosity index improver (B) The results are shown in Table 3.

Example 3

The procedure of Example 1 was repeated except for using 0.70% by weight of an ethylene•propylene copolymer prepared in Polymerization Example 3 as a viscosity index improver (B). The results are shown in Table 3.

TABLE 3

| | Example 1 | Example 2 | Example 3 |
|---|---|---|---|
| Ethylene•propylene copolymer (B) blended | Polymerization Example 2 | Polymerization Example 5 | Polymerization Example 3 |

TABLE 3-continued

| | Example 1 | Example 2 | Example 3 |
|---|---|---|---|
| Composition (wt %) | | | |
| Lubricating oil base (A) (base oil) | 87.85 | 87.94 | 88.00 |
| Ethylene•propylene copolymer (B)*1 | 0.85 | 0.76 | 0.70 |
| Pour-point depressant ACLUBE 146*2 | 0.30 | 0.30 | 0.30 |
| Detergent-dispersant (LZ 20003C) | 11.00 | 11.00 | 11.00 |
| *1 [η] (dl/g) of Ethylene•propylene copolymer (B) | 1.45 | 1.60 | 1.84 |
| *2 Melting point (° C.) of Pour-point depressant (C) (° C.) | −19.0 | −19.0 | −19.0 |
| *2 Weight average molecular weight (Mw) of Pour-point depressant (C) | 56100 | 56100 | 56100 |
| Lubricating oil properties | | | |
| Dynamic viscosity @ 100° C. ($mm^2/s$) | 11.02 | 10.96 | 11.00 |
| CCS viscosity @ −25° C. (mPa · s) | 3090 | 3050 | 3010 |
| CCS viscosity @ −30° C. (mPa · s) | 6200 | 6120 | 6060 |
| MR viscosity @ −35° C. (mPa · s) | 32500 | 29600 | 30650 |
| SSI | 41 | 44 | 46 |

The designation "@XX° C." refers to measurement made at XX° C. Hereinafter, the designation "@XX° C." is the same.

Example 4

Using 87.37% by weight of a 120 neutral mineral oil (manufactured by ESSO Co., Ltd.) as a lubricating oil base (A) (base oil), 0.83% by weight of an ethylene•propylene copolymer prepared in Polymerization Example 2 as a viscosity index improver (B), 0.3% by weight of ACLUBE 146™ (manufactured by Sanyo Chemical Industries, Ltd.) as a pour point depressant (C) and 11.5% by weight of a detergent-dispersant LZ 20003C™ (manufactured by The Lubrizol Corporation), a lubricating oil composition was prepared and then the lubricating oil properties thereof were evaluated.

The results are shown in Table 4.

Examples 5

The procedure of Example 4 was repeated except for using 87.46% by weight of a 120 neutral mineral oil (manufactured by ESSO Co., Ltd.) and 0.74% by weight of an ethylene•propylene copolymer prepared in Polymerization Example 5 as a viscosity index improver (B). The results are shown in Table 4.

Examples 6

The procedure of Example 4 was repeated except for using 87.52% by weight of a 120 neutral mineral oil (manufactured by ESSO Co., Ltd.) and 0.68% by weight of an ethylene•propylene copolymer prepared in Polymerization Example 3 as a viscosity index improver (B). The results are shown in Table 4.

Examples 7

The procedure of Example 4 was repeated except for using ACLUBE 136 (™, manufactured by Sanyo Chemical Industries, Ltd.) as a pour point depressant (C).

The results are shown in Table 4.

Examples 8

The procedure of Example 5 was repeated except for using ACLUBE 136 (™, manufactured by Sanyo Chemical Industries, Ltd.) as a pour point depressant (C).

The results are shown in Table 4.

Examples 9

The procedure of Example 6 was repeated except for using ACLUBE 136 (™, manufactured by Sanyo Chemical Industries, Ltd.) as a pour point depressant (C).

The results are shown in Table 4.

TABLE 4

| | Example 4 | Example 5 | Example 6 |
|---|---|---|---|
| Ethylene•propylene copolymer (B) blended | Polymerization Example 2 | Polymerization Example 5 | Polymerization Example 3 |
| Composition (wt %) | | | |
| Lubricating oil base (A) (base oil) | 87.37 | 87.46 | 87.52 |
| Ethylene•propylene copolymer (B)*1 | 0.83 | 0.74 | 0.68 |
| Pour-point depressant (C) ACLUBE 146*2 | 0.30 | 0.30 | 0.30 |
| Pour-point depressant (C) ACLUBE 136*2 | | | |
| Detergent-dispersant (LZ 20003C) | 11.50 | 11.50 | 11.50 |
| *1 [η] (dl/g) of Ethylene•propylene copolymer (B) | 1.45 | 1.60 | 1.84 |
| *2 Melting point (° C.) of Pour-point depressant (C) (° C.) | −19.0 | −19.0 | −19.0 |
| *2 Weight average molecular weight (Mw) of Pour-point depressant (C) | 56100 | 56100 | 56100 |
| Lubricating oil properties | | | |
| Kinematic viscosity @ 100° C. ($mm^2/s$) | 10.88 | 10.79 | 10.72 |
| CCS viscosity @ −25° C. (mPa · s) | 3060 | 3040 | 3040 |
| MR viscosity @ −35° C. (mPa · s) | 29170 | 28280 | 28820 |
| SSI | 41 | 44 | 46 |

| | Example 7 | Example 8 | Example 9 |
|---|---|---|---|
| Ethylene•propylene copolymer (B) blended | Polymerization Example 2 | Polymerization Example 5 | Polymerization Example 3 |
| Composition (wt %) | | | |
| Lubricating oil base (A) (base oil) | 87.37 | 87.46 | 87.52 |
| Ethylene•propylene copolymer (B)*1 | 0.83 | 0.74 | 0.68 |
| Pour-point depressant (C)ACLUBE 146*2 | | | |
| Pour-point depressant (C) ACLUBE 136*2 | 0.30 | 0.30 | 0.30 |
| Detergent-dispersant (LZ 20003C) | 11.50 | 11.50 | 11.50 |
| *1 [η] (dl/g) of Ethylene•propylene copolymer (B) | 1.45 | 1.60 | 1.84 |
| *2 Melting point (° C.) of Pour-point depressant (C) (° C.) | −18.1 | −18.1 | −18.1 |
| *2 Weight average molecular weight (Mw) of Pour-point depressant (C) | 100200 | 100200 | 100200 |
| Lubricating oil properties | | | |
| Kinematic viscosity @ 100° C. ($mm^2/s$) | 10.90 | 10.91 | 10.76 |
| CCS viscosity @ −25° C. (mPa · s) | 3050 | 3040 | 3010 |
| MR viscosity @ −35° C. (mPa · s) | 28640 | 28950 | 29060 |
| SSI | 42 | 45 | 46 |

Comparative Example 1

The procedure of Example 4 was repeated except for using 87.70% by weight of a 120 neutral mineral oil (manufactured by ESSO Co., Ltd.) and 1.00% by weight of an ethylene•propylene copolymer prepared in Polymerization Example 1 as a viscosity index improver (B). The results are shown in Table 5.

Comparative Example 2

The procedure of Example 1 was repeated except for using 88.09% by weight of a 120 neutral mineral oil (manufactured by ESSO Co., Ltd.) and 0.61% by weight of an ethylene•propylene copolymer prepared in Polymerization Example 4 as a viscosity index improver (B). The results are shown in Table 5.

TABLE 5

| | Comparative Example 1 | Comparative Example 2 |
|---|---|---|
| Ethylene•propylene copolymer (B) blended | Polymerization Example 1 | Polymerization Example 4 |
| Composition (wt %) | | |
| Lubricating oil base (A) (base oil) | 87.70 | 88.09 |
| Ethylene•propylene copolymer (B) | 1.00 | 0.61 |
| [η] (dl/g) of Ethylene•propylene copolymer (B) | 1.20 | 2.18 |
| Pour-point depressant (C) ACLUBE 146 | 0.30 | 0.30 |
| Detergent-dispersant (LZ 20003C) | 11.00 | 11.00 |
| Lubricating oil propertie s | | |
| Kinematic viscosity @ 100° C. ($mm^2/s$) | 10.92 | 10.98 |
| CCS viscosity @ −25° C. (mPa · s) | 3120 | 2950 |
| CCS viscosity @ −30° C. (mPa · s) | 6280 | 6010 |
| MR viscosity @ −35° C. (mPa · s) | 52500 | 48600 |
| SSI | 30 | 57 |

Comparative Example 3

Using 87.22% by weight of a mineral oil (manufactured by ESSO Co., Ltd.), which is classified as group (II), having a kinematic viscosity at 100° C. of 4.60 $mm^2/s$, as a lubricating oil base (A) (base oil), 0.98% by weight of an ethylene•propylene copolymer prepared in Polymerization Example 1 as a viscosity index improver (B), 0.3% by weight of ACLUBE 146™ (manufactured by Sanyo Chemical Industries, Ltd.) as a pour point depressant (C) and 11.5% by weight of a detergent-dispersant LZ 20003C™ manufactured by The Lubrizol Corporation), a lubricating oil composition was prepared and then the lubricating oil properties thereof were evaluated.

The results are shown in Table 6.

Comparative Example 4

The procedure of Comparative Example 3 was repeated except for using 87.61% by weight of a mineral oil having a kinematic viscosity at 100° C. of 4.60 $mm^2/s$, (manufactured by ESSO Co., Ltd.) and 0.59% by weight of an ethylene•propylene copolymer prepared in Polymerization Example 4 as a viscosity index improver (B). The results are shown in Table 6.

Comparative Example 5

The procedure of Comparative Example 3 was repeated except for using ACLUBE 136™ (manufactured by Sanyo Chemical Industries, Ltd.) as a pour point depressant (C).

The results are shown in Table 6.

Comparative Example 6

The procedure of Comparative Example 4 was repeated except for using ACLUBE 136 (™, manufactured by Sanyo Chemical Industries, Ltd.) as a pour point depressant (C).

The results are shown in Table 6.

TABLE 6

| | Comparative Example 3 | Comparative Example 4 |
|---|---|---|
| Ethylene•propylene copolymer (B) blended Composition (wt %) | Polymerization Example 1 | Polymerization Example 4 |
| Lubricating oil base (A) (base oil) | 87.22 | 87.61 |
| Ethylene•propylene copolymer (B)*1 | 0.98 | 0.59 |
| Pour-point depressant (C) ACLUBE 146*2 | 0.30 | 0.30 |
| Pour-point depressant (C) ACLUBE 136*2 | | |
| Detergent-dispersant (LZ 20003C) | 11.50 | 11.50 |
| *1 [η] (dl/g) of Ethylene•propylene copolymer (B) | 1.20 | 2.18 |
| *2 Melting point (° C.) of Pour-point depressant (C) (° C.) | −19.0 | −19.0 |
| *2 Weight average molecular weight (Mw) of Pour-point depressant (C) | 56100 | 56100 |
| Lubricating oil properties | | |
| Kinematic viscosity @ 100° C. ($mm^2/s$) | 10.79 | 10.88 |

TABLE 6-continued

| | | |
|---|---|---|
| CCS viscosity @ −25° C. (mPa · s) | 3120 | 2950 |
| MR viscosity @ −35° C. (mPa · s) | 52870 | 48650 |
| SSI | 30 | 57 |

| | Comparative Example 5 | Comparative Example 6 |
|---|---|---|
| Ethylene•propylene copolymer (B) blended Composition (wt %) | Polymerization Example 1 | Polymerization Example 4 |
| Lubricating oil base (A) (base oil) | 87.22 | 87.61 |
| Ethylene•propylene copolymer (B)*1 | 0.98 | 0.59 |
| Pour-point depressant (C) ACLUBE 146*2 | | |
| Pour-point depressant (C) ACLUBE 136*2 | 0.30 | 0.30 |
| Detergent-dispersant (LZ 20003C) | 11.50 | 11.50 |
| *1 [η] (dl/g) of Ethylene•propylene copolymer (B) | 1.20 | 2.18 |
| *2 Melting point (° C.) of Pour-point depressant (C) (° C.) | −18.1 | −18.1 |
| *2 Weight average molecular weight (Mw) of Pour-point depressant (C) | 100200 | 100200 |
| Lubricating oil properties | | |
| Kinematic viscosity @ 100° C. ($mm^2/s$) | 10.85 | 10.91 |
| CCS viscosity @ −25° C. (mPa · s) | 3150 | 2930 |
| MR viscosity @ −35° C. (mPa · s) | 54330 | 51740 |
| SSI | 30 | 57 |

Example 10

The procedure of Example 4 was repeated except for using ACLUBE 133 (™, manufactured by Sanyo Chemical Industries, Ltd.) as a pour point depressant (C).

The results are shown in Table 7.

Example 11

The procedure of Example 5 was repeated except for using ACLUBE 133 (™, manufactured by Sanyo Chemical Industries, Ltd.) as a pour point depressant (C).

The results are shown in Table 7.

Example 12

The procedure of Example 6 was repeated except for using ACLUBE 133 (™, manufactured by Sanyo Chemical Industries, Ltd.) as a pour point depressant (C).

The results are shown in Table 7.

Example 13

The procedure of Example 4 was repeated except for using VISCOPLX 1-156 (™, manufactured by Roh Max Co., Ltd.) as a pour point depressant (C).

The results are shown in Table 7.

Example 14

The procedure of Example 5 was repeated except for using VISCOPLX 1-156 (™, manufactured by Roh Max Co., Ltd.) as a pour point depressant (C).

The results are shown in Table 7.

Example 15

The procedure of Example 6 was repeated except for using VISCOPLX 1-156 (™, manufactured by Roh Max Co., Ltd.) as a pour point depressant (C).

The results are shown in Table 7.

TABLE 7

| | Example 10 | Example 11 | Example 12 |
|---|---|---|---|
| Ethylene•propylene copolymer (B) blended | Polymerization Example 2 | Polymer-ization Example 5 | Polymer-ization Example 3 |
| Composition (wt %) | | | |
| Lubricating oil base (A) (base oil) | 87.37 | 87.46 | 87.52 |
| Ethylene•propylene copolymer (B)*1 | 0.83 | 0.74 | 0.68 |
| Pour-point depressant (C) ACLUBE 133*2 | 0.30 | 0.30 | 0.30 |
| Pour-point depressant (C) VISCOPLX 1-156*2 | | | |
| Detergent-dispersant (LZ 20003C) | 11.50 | 11.50 | 11.50 |
| *1 [η] (dl/g) of Ethylene•propylene copolymer (B) | 1.45 | 1.60 | 1.84 |
| *2 Melting point (° C.) of Pour-point depressant (C) (° C.) | −11.4 | −11.4 | −11.4 |
| *2 Weight average molecular weight (Mw) of Pour-point depressant (C) | 418000 | 418000 | 418000 |
| Lubricating oil properties | | | |
| Kinematic viscosity @ 100° C. ($mm^2/s$) | 10.91 | 10.88 | 10.82 |
| CCS viscosity @ −25° C. (mPa · s) | 3090 | 3060 | 3050 |
| MR viscosity @ −35° C. (mPa · s) | 42870 | 41650 | 42330 |
| SSI | 42 | 45 | 47 |

| | Example 13 | Example 14 | Example 15 |
|---|---|---|---|
| Ethylene•propylene copolymer (B) blended | Polymerization Example 2 | Polymer-ization Example 5 | Polymer-ization Example 3 |
| Composition (wt %) | | | |
| Lubricating oil base (A) (base oil) | 87.37 | 87.46 | 87.52 |
| Ethylene•propylene copolymer (B)*1 | 0.83 | 0.74 | 0.68 |
| Pour-point depressant (C) ACLUBE 133*2 | | | |
| Pour-point depressant (C) VISCOPLX 1-156*2 | 0.30 | 0.30 | 0.30 |
| Detergent-dispersant (LZ 20003C) | 11.50 | 11.50 | 11.50 |
| *1 [η] (dl/g) of Ethylene•propylene copolymer (B) | 1.45 | 1.60 | 1.84 |
| *2 Melting point (° C.) of Pour-point depressant (C) (° C.) | −8.7 | −8.7 | −8.7 |
| *2 Weight average molecular weight (Mw) of Pour-point depressant (C) | 75600 | 75600 | 75600 |
| Lubricating oil properties | | | |
| Kinematic viscosity @ 100° C. ($mm^2/s$) | 10.94 | 10.80 | 10.77 |
| CCS viscosity @ −25° C. (mPa · s) | 3080 | 3060 | 3010 |
| MR viscosity @ −35° C. (mPa · s) | 44740 | 43880 | 44180 |
| SSI | 42 | 44 | 46 |

The invention claimed is:

1. A lubricating oil composition (BB) comprising 92 to 99.85% by weight of a lubricating oil base (A) having a kinematic viscosity at 100° C. of 1 to 50 $mm^2/s$, 0.1 to 5% by weight of an ethylene•propylene copolymer (B), and 0.05 to 3% by weight of a pour-point depressant (C) having a melting point as measured with DSC of not higher than −15° C., wherein the lubricating oil base (A) has (A1) a viscosity index of not less than 80, (A2) a saturated hydrocarbon content of not less than 90% by volume, and (A3) a sulfur content of not more than 0.03% by weight and the ethylene•propylene copolymer (B) has (B1) an ethylene content of from 30 to 75% by weight, (B2) an intrinsic viscosity [η] of 1.3 to 2.0 dl/g, (B3) a Mw/Mn of not more than 2.4, and (B4) a melting point as measured with DSC of not higher than 30° C.

2. A lubricating oil for internal-combustion engines which oil comprises the lubricating oil composition (BB) as claimed in claim 1.

3. The lubricating oil composition (BB) of claim 1 wherein the lubricating oil base (A) is a mineral oil.

* * * * *